US008235824B2

(12) United States Patent
Kuhn

(10) Patent No.: US 8,235,824 B2
(45) Date of Patent: Aug. 7, 2012

(54) COMPOSITE TABLETOP FOR ELECTRONIC GAME TABLES

(75) Inventor: Tyler V. Kuhn, Spokane, WA (US)

(73) Assignee: DigiDeal Corporation, Spokane, WA (US)

( * ) Notice: Subject to any disclaimer, the term of this patent is extended or adjusted under 35 U.S.C. 154(b) by 924 days.

(21) Appl. No.: 12/260,989

(22) Filed: Oct. 29, 2008

(65) Prior Publication Data

US 2010/0105485 A1 Apr. 29, 2010

(51) Int. Cl.
*A63F 11/00* (2006.01)

(52) U.S. Cl. ..... 463/46; 463/47; 273/309

(58) Field of Classification Search ..... 463/46, 463/47; 273/148 R, 148 B, 309; 108/25, 108/33, 42, 50.01, 50.02, 50.13, 57.25, 57.27, 108/57.28, 90, 161; 264/241; 428/34.1; 156/242

See application file for complete search history.

(56) References Cited

U.S. PATENT DOCUMENTS 3,940,136 A * 2/1976 Runte ..... 463/3
4,521,021 A * 6/1985 Dixon ..... 463/47
4,813,675 A * 3/1989 Greenwood ..... 463/46
5,112,060 A * 5/1992 Jones ..... 273/309
5,377,994 A * 1/1995 Jones ..... 273/309
5,417,433 A * 5/1995 Phillips ..... 273/309
5,441,279 A * 8/1995 Messina ..... 273/309
6,435,970 B1 * 8/2002 Baerlocher et al. ..... 463/46
6,561,897 B1 * 5/2003 Bourbour et al. ..... 463/13
2006/0055114 A1 * 3/2006 White et al. ..... 273/309
2008/0115697 A1 * 5/2008 Beam ..... 108/26

* cited by examiner

*Primary Examiner* — Dmitry Suhol
*Assistant Examiner* — David Duffy
(74) *Attorney, Agent, or Firm* — Farrell Patent Law PC; Mark Farrell

(57) ABSTRACT

Composite tabletops for electronic game tables are described. In one implementation, the composite tabletop has a channeled core layer sandwiched between a bottom layer and top layer. The channeled core layer is constructed of foam, so that the foam forms enclosure spaces for player stations, displays, user-interface hardware, central control/server hardware, and cooling equipment. The foam is also shaped to form duct spaces between each player station and a central space in the channeled core layer. The ducts can be used to route wires between each player station and the central space and to direct cooling air to or from each player station. The channeled core layer reduces time and labor during manufacture of an electronic game table and results in an electronic game table that is more lightweight for shipping, absorbs noise generated by enclosed hardware and electronics, absorbs shocks, and optimizes cooling of enclosed components.

19 Claims, 6 Drawing Sheets

COMPOSITE TABLETOP FOR ELECTRONIC GAME TABLES

BACKGROUND

Electronic game tables, such as those used for multi-player gambling in casinos or card rooms, typically have a wood or metal construction. Conventional problems to be overcome during construction of an electronic table game include how to sturdily mount the hardware, including displays, electronics, and other user interfaces against the handling and sometime abuse of the public players who will use the game table. Designing and building such mounts can be labor intensive. Other design considerations include how to keep the hardware and electronics quiet and how to cool the hardware and electronics inside an enclosed game table. Finally, electronic game tables are typically manufactured and shipped great distances, including overseas. So a further design consideration is keeping the shipping weight of an electronic game table reasonably low.

What is needed is a table structure that addresses these considerations of hardware mounting, ease of construction, sound control, component cooling, and minimization of shipping weight.

SUMMARY

Composite tabletops for electronic game tables are described. In one implementation, the composite tabletop has a channeled core layer sandwiched between a bottom layer and top layer. The channeled core layer is constructed of foam, so that the foam forms enclosure spaces for player stations, displays, user-interface hardware, central control/server hardware, and cooling equipment. The foam is also shaped to form duct spaces between each player station and a central space in the channeled core layer. The ducts can be used to route wires between each player station and the central space and to direct cooling air to or from each player station. The channeled core layer reduces time and labor during manufacture of an electronic game table and results in an electronic game table that is more lightweight for shipping, absorbs noise generated by enclosed hardware and electronics, absorbs shocks, and optimizes cooling of enclosed components.

This summary section is not intended to give a full description of composite tabletops for electronic game tables, or to provide a list of features and elements. A detailed description of example embodiments of the electronic gaming system follows.

DETAILED DESCRIPTION

Overview

This disclosure describes composite tabletops for electronic game tables. In one implementation, an exemplary tabletop is a composite structure, utilizing a channeled core that results in a semi-hollow tabletop structure. The channeled core may be constructed of solid foam or built-up foam that is molded, shaped, or cut out to create the channels. The channeled core can be sandwiched between wood, metal, or engineered composite top and bottom layers. The solid or built-up foam channeled core provides tabletop thickness to house electronics and other hardware for the electronic game while providing adequate structural rigidity, reducing weight, absorbing sound created by electronic equipment, optimizing cooling of enclosed components, and cushioning sudden impacts, both during shipping and during game play. The foam channeled core also decreases the weight and shipping costs of an electronic game table.

The channels serve multiple purposes, such as providing routing runs for cables between player stations and a central electronic server core, and directing airflow for cooling electronic or electromagnetic components. Channels for wire routing and for airflow can be designed into the negative space of cut solid foam. Additional layers can be added to the tabletop, for example, a finishing layer that includes a graphic overlay. Using foam to construct the channeled core also provides ease of manufacture as compared to alternative constructions that are more labor intensive (i.e., individual pieces of wood or metal framing). The layers, including the channeled core, can be assembled into a single tabletop piece using an adhesive or mechanical fasteners.

Example Electronic Game Tables

The composite tabletops described herein can be used to create game tables that have a shape or tabletop appearance similar to those described below. The exemplary composite game tabletops and the techniques for constructing them can also be used to make many other shapes and configurations of game tabletops that have the innovative features described herein.

Figure 1:
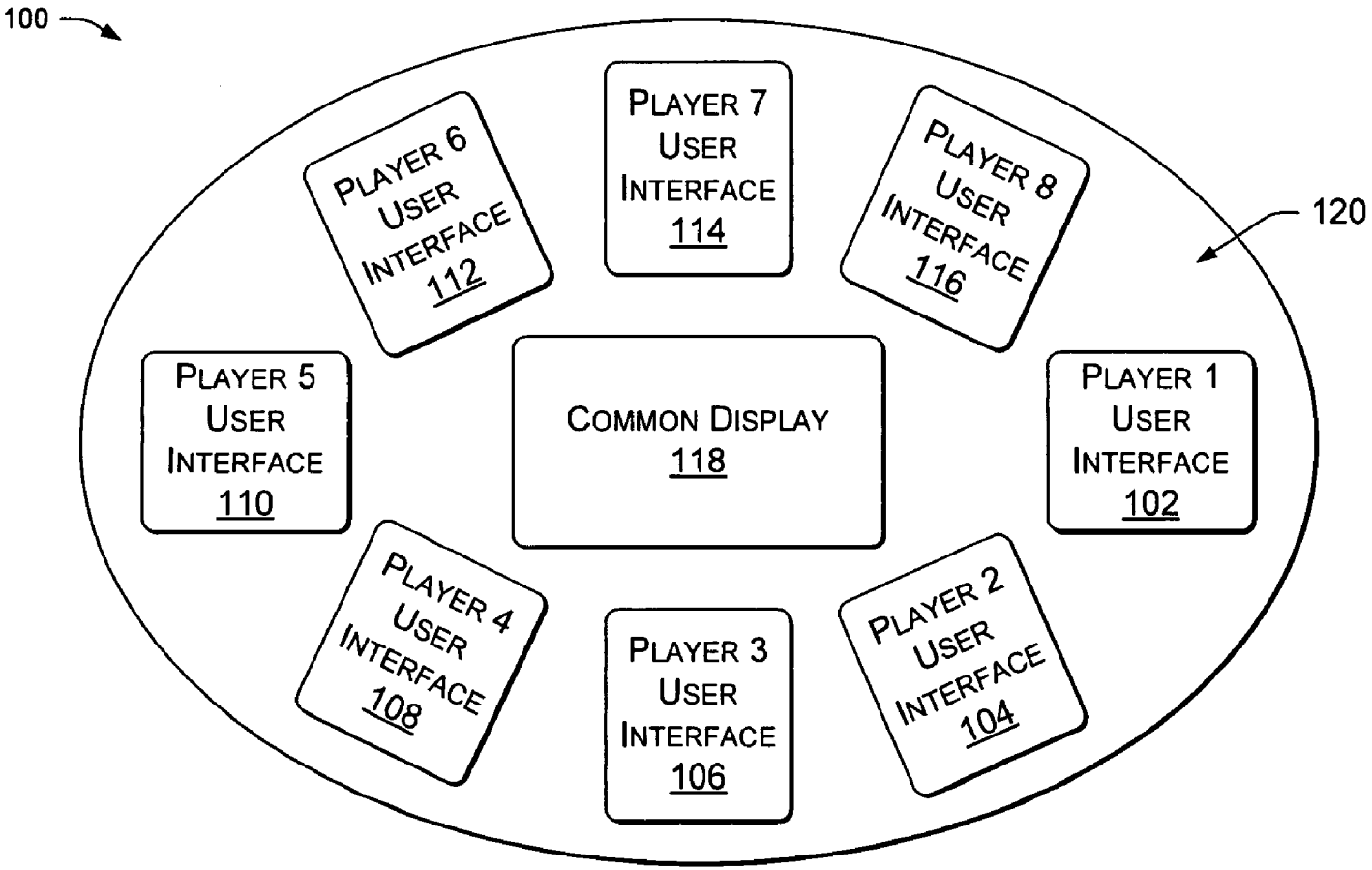
FIG. 1 is a top view of a multiplayer electronic game table that has an exemplary composite tabletop.

FIG. 1 shows an example layout of an electronic game table 100. The illustrated example game table 100 has an arbitrary size that in shown version seats eight participants maximum. Other implementations can seat a different number of participants. The game table 100 has a user interface for each participant, i.e., participant user interfaces 102, 104, 106, 108, 110, 112, 114, and 116. A participant's user interface 102 may consist of an electronic display for presenting visual images and may further consist of a touch screen display for interactive capability. Depending upon implementation, each participant user interface 102 may also include various other forms of interactive interface, such as pointing devices, light sensors, wagering chip sensors, audio speakers, etc.

The illustrated example game table 100 may also include a common display 118 in the center of the game table 100, for presenting visual information to all participants. The common display(s) 118 may present general information redundantly in two, four, or more visual orientations so that the displayed information is oriented correctly for each participant.

The example electronic game table 100 of FIG. 1 has an example layout that is useful for unhosted card games, although using a live dealer at game table 100 is not ruled out. The example game table 100 as shown typically uses virtual playing cards and virtual chips. However, the game table 100 can be configured to use any combination of real playing cards, virtual playing cards, real wagering chips, and/or virtual gaming chips. When real playing cards are used, a live shoe that reads the identity of each card sends the card identity information to the electronic processor (not shown) that runs the game. When real wagering chips are used, light sensors, optical sensors, scanning technology, weigh cells, RFID technology, etc., may be used with specially constructed chips or conventional standard chips to sense chip presence and chip values. The exemplary electronic game table 100 has an exemplary composite tabletop 120 to be described in more detail below.

Figure 2:
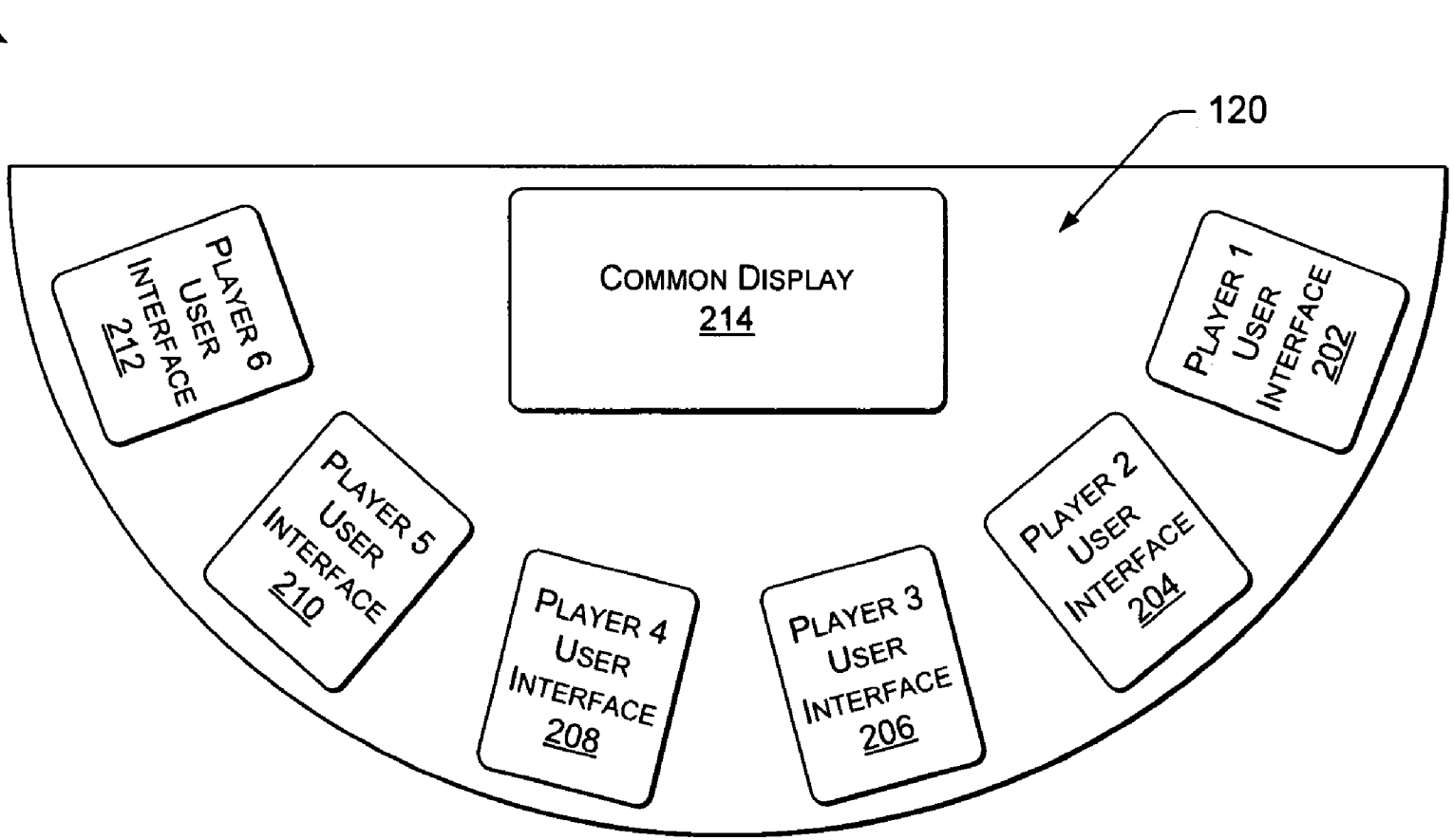
FIG. 2 is a top view of another multiplayer electronic game table that has an exemplary composite tabletop.

FIG. 2 shows another example layout of an electronic game table 200. In the illustrated example game table 200, multiple user interfaces 202, 204, 206, 208, 210, and 212 form a semi-circular array for seating participants. The participant user interfaces may consist of electronic visual displays with touch screen capability or other forms of user interface. The example game table 200 is shaped to accommodate a live dealer on the opposing side of the semi-circular array, but using a live dealer or host is not required. When the example game table 200 is not hosted, a common display 214 can be included on the side opposing the participants' semi-circle. The exemplary electronic game table 200 has an exemplary composite tabletop 120 to be described in more detail below.

Figure 3:
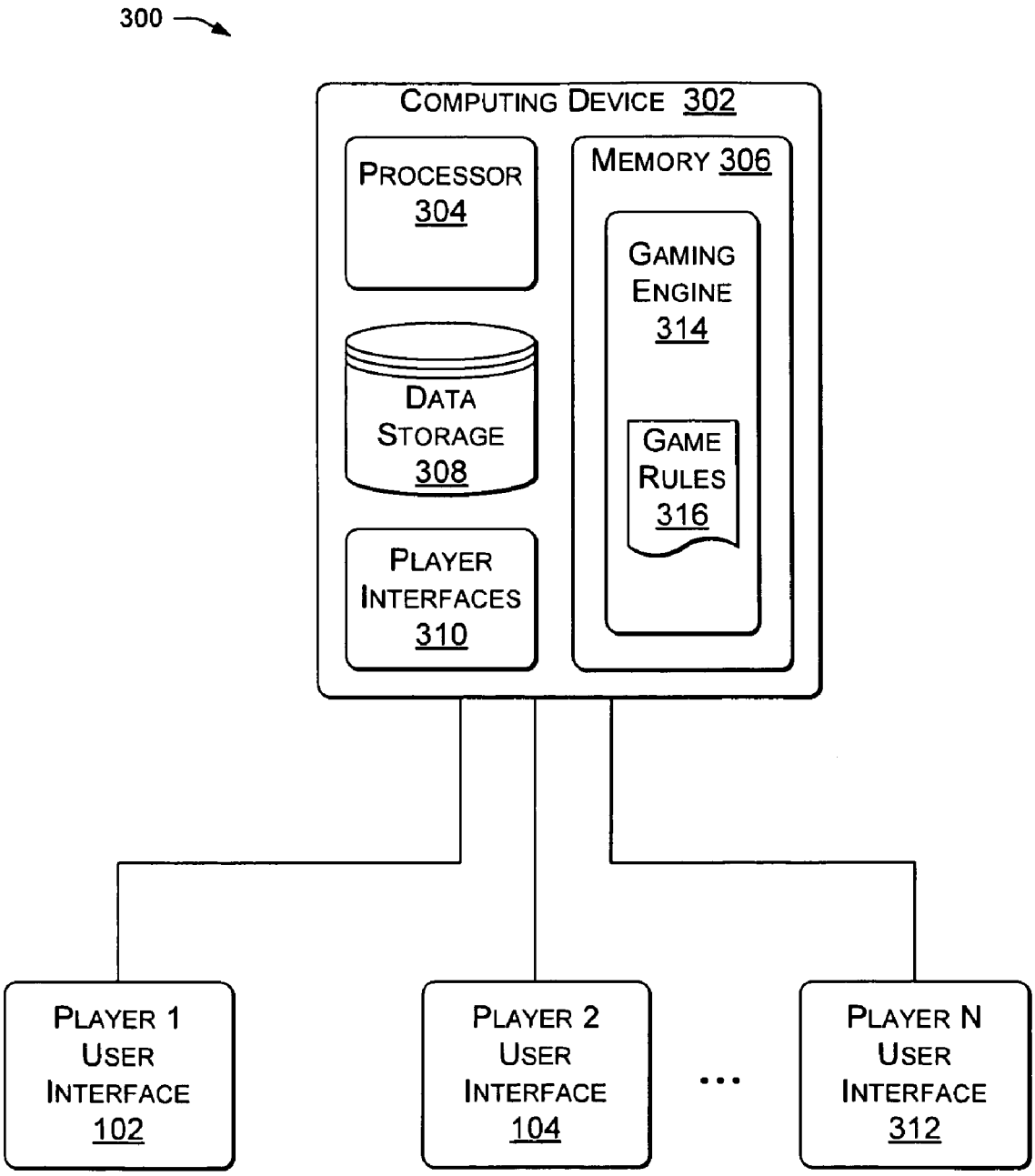
FIG. 3 is a block diagram of an example game processing system for use in an electronic game table that has an exemplary composite tabletop.

FIG. 3 shows an example game processing system 300 that can be included in game tables, such as in the game tabletops for electronic game tables 100 and 200. The illustrated configuration of the exemplary game processing system 300 is meant to provide only one example arrangement for the sake of overview. Many other arrangements of the illustrated components, or similar components, are possible within the scope of the subject matter. Such an exemplary game processing system 300 can be executed in hardware, or combinations of hardware, software, firmware, etc.

The exemplary game processing system 300 includes a computing device 302, which may be a desktop, server, or notebook style computer, or other device that has processor, memory, and data storage. The computing device 302 thus includes a processor 304, memory 306, data storage 308; and interface(s) 310 to communicatively couple with the participant "1" user interface 102, the participant "2" user interface 104, . . . , and the participant "N" user interface 312. The game processing system 300 includes a gaming engine 314, and game rules 316, shown as software loaded into memory 306.

The interfaces 310 can be one or more hardware components that drive the visual displays and communicate with the interactive components, e.g., touch screen displays, of the multiple participant user interfaces 102, 104, . . . , 312.

Example Composite Tabletop Construction

Figure 4:
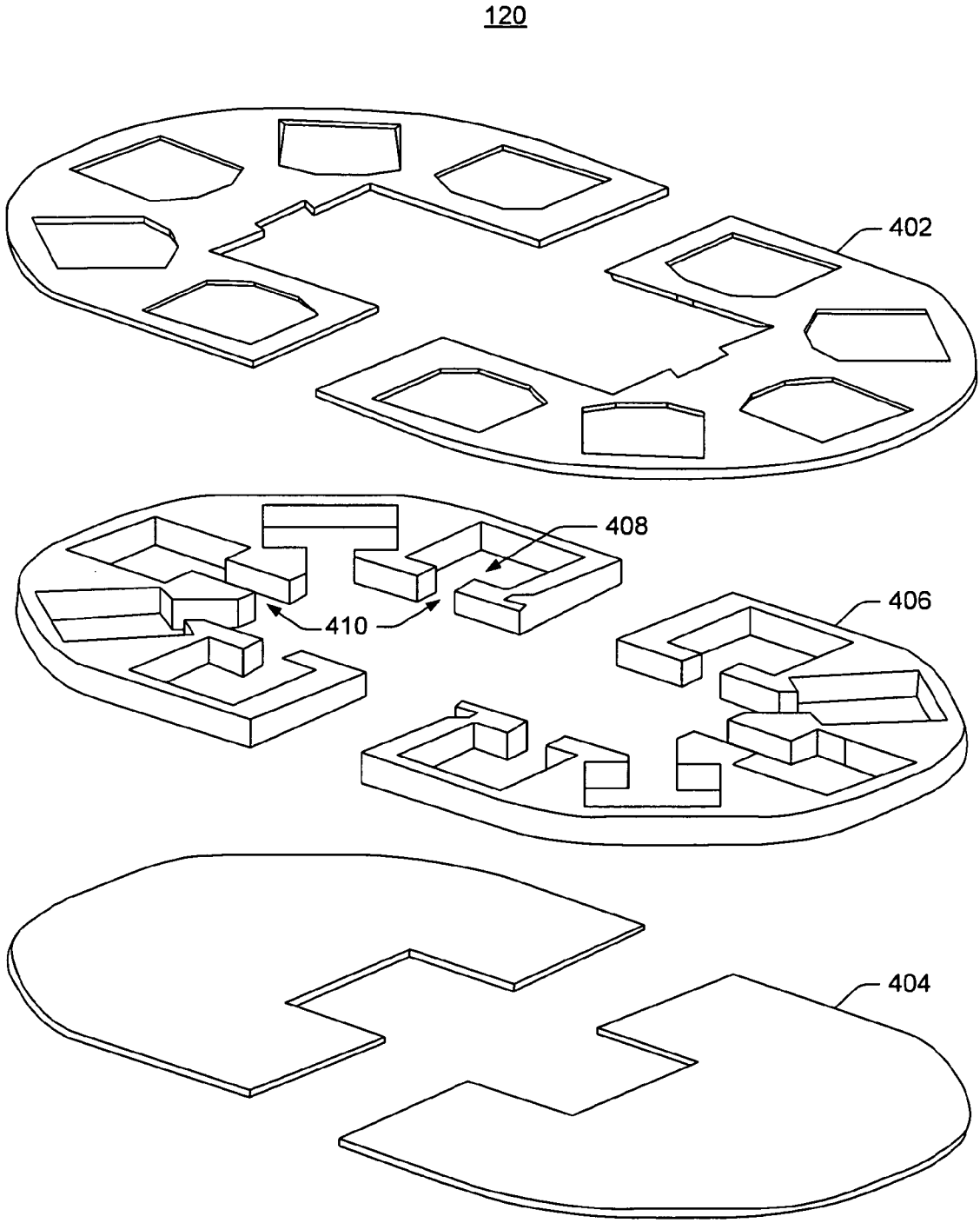
FIG. 4 is a diagram of layers of the exemplary composite tabletop.

FIG. 4 shows an exploded view of layer components of the example composite tabletop 120 for electronic games. The illustrated exemplary tabletop 120 is suitable for an electronic table game for up to ten players. The exemplary tabletop construction can be applied to many other types of game tabletops, such as a tabletop for game table 100 in FIG. 1 that serves up to eight players and as a tabletop for game table 200 in FIG. 2 that serves up to six players.

In FIG. 4, the exemplary tabletop 120 has a top layer 402 and a bottom layer 404, each made of a hard material, such as wood, metal, or engineered composite. An engineered composite material is made from two or more constituent materials that remain separate and distinct on a macroscopic level while forming a single component. Example composite materials that can be used for the top layer 402 and the bottom layer 404 include fiber reinforced plastics in which the reinforcement fiber is wood, carbon-fiber composites, glass-fiber composites; fiber thermoplastics, glass mat thermoplastics, metal matrix composites, carbon-carbon composites (carbon fiber in a graphite matrix), engineered wood, plastic-impregnated laminates, such as FORMICA; etc.

The bottom layer 404 typically receives support from connected legs (not shown) and in turn provides support to a channeled core layer 406 and the top layer 402. The top layer 402 provides the working-surface that interfaces with human users, or provides a base of support for one or more additional cover layers (not shown) that constitute the work-surface. The top layer 402 or the additional cover layers may have corresponding features for optimizing direct contact with human users, such as smoothness for skin contact, durability for wear, an ability to be cleaned, visual attractiveness, and graphics relevant to the particular game that the tabletop 120 is being used for. The top layer 402 may also have cutouts, e.g., for user interfaces, such as touch screen displays, common displays, and game controls.

The channeled core layer 406 constitutes a channeled spacer between the bottom layer 404 and the top layer 402. In one implementation, because the channeled core layer 406 is made of foam, it is lightweight to work with and easily cut to make enclosures (e.g., 408) for equipment, such as player stations. The player stations may consists of a display, a touch screen display, a workstation computing device, or a laptop or notebook computer, depending on implementation of the electronic game table. The channeled core layer 406 greatly reduces the weight of an entire electronic game table over conventional table designs that use solid wood or metal mounting for various user interfaces. The channeled core layer 406 also reduces noise or sound generated by multiple player stations, i.e., when the players stations are computing devices that have audible parts, such as fans, hard drives, or even compact disc drives that generate sound.

Depending on a particular implementation, each duct (e.g., ducts 410) cut into the foam or formed by the foam channeled core layer 406 serves the multiple purposes of routing wires, bundling the wires in some implementations, and creating a limited access opening 410 to the enclosure 408 for directing airflow. Because the enclosure 408 closely surrounds the electronic equipment it contains, thereby creating a limited enclosure space, any movement of air through the relatively narrow duct 410 creates a related airflow of sufficient cooling velocity immediately around the electronic equipment itself. Each enclosure typically has air holes (not shown) in the bottom layer 404, or in an enclosure wall of the channeled core layer 406, or even in the top layer 402 to allow air into or out of each enclosure space 408. Once the top layer 402, the bottom layer 404, and the channeled core layer 406 are bonded together, a cooling fan in the electronic game table may draw air from the enclosures 408 via the ducts 310 creating a mild partial vacuum that draws cooling air into the enclosures 408 via the air holes. Alternatively, the cooling fan may force cooling air into the enclosures 408 via the ducts 410 thereby forcing air out of the air holes. The ducts 410 may also route cooling tubes when a liquid cooling system is used instead of an air cooling system.

The channeled core layer 406 can be made of solid foam, as introduced above, or can be built up from pieces of relatively stiff foam, leaving additional empty spaces in the structure of the channeled core layer 406, e.g., between enclosure spaces 408, so that the non-cutout parts of the foam are themselves hollow, being made of foam walls with space between. That is, the parts of the foam that would be solid foam when solid foam is used, are hollow when the channeled core structure is built-up using only foam walls instead of solid foam.

Many types of foam may be used for the channeled core layer 406, depending on implementation. Candidate foams include polystyrene foams, such as extruded polystyrene foam with a closed-cell structure and a density of approximately 28-45 kg/cubic meter, e.g., STYROFOAM; polymethacrylimide foams, polyvinylchloride foams, e.g., with density of approximately 30-120 kg/cubic meter; polyurethane foams, such as LAST-A-FOAM FR-7100, a fine-celled high-density polyurethane foam (General Plastics Manufacturing Company, Tacoma Wash.); polypropylene foams including closed-cell thermoplastic olefinic foam; and polyethylene foams. Foam alternatives may also be used, such as KEVLAR paper expanded into layers of a mesh or honeycomb structure, e.g., NOMEX sandwich material (DuPont Corporation, Wilmington Del.). LAST-A-FOAM FR-7100, for example, at densities between approximately 64-160 kg/cubic meter, is an excellent medium for the channeled core layer 406, with an exceptionally fine closed-cell structure that enhances paintability and finishing. It is easily bonded and finished with a wide variety of adhesives and coatings and is dimensionally stable, grain-free, and easy to shape with a variety of cutting processes. Lower-density LAST-A-FOAM FR-7100 hand-carves and may be shaped with common woodworking tools. Higher-density versions can be cut with powered or computer-numerical-control tools where more accuracy is desired. LAST-A-FOAM FR-7100 can be bonded, filled, sealed and painted with a wide variety of commercially available finishing products.

Figure 5:
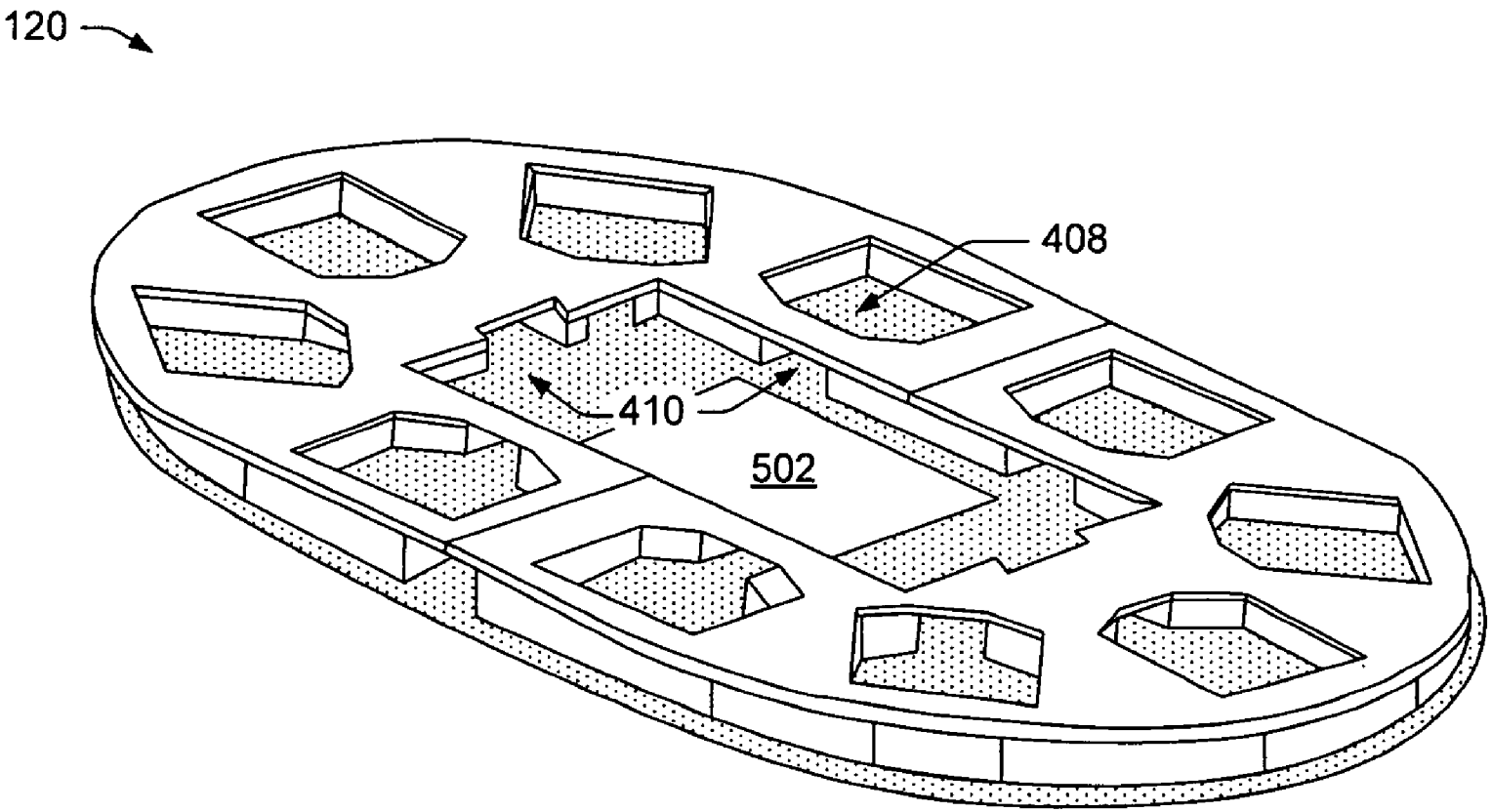
FIG. 5 is a diagram of the exemplary composite tabletop with layers bonded together.

FIG. 5 shows the exemplary composite tabletop 120 with the top layer 402, the bottom layer 404, and the channeled core layer 406 bonded together, e.g., with mechanical fasteners (e.g., screws, bolts, nails, staples, etc.) or with an adhesive suitable for foam or for the material selected to construct the channeled core layer 406. Each enclosure 408 is designed to closely surround the electronics and hardware of a player station, e.g., by conforming to the size and shape of the player station, leaving a few centimeters of space around the outside of the hardware for air cooling.

The openings in the top of the exemplary composite tabletop 120 are then occupied by display hardware and player stations, thereby occluding all the top openings in the composite tabletop 120. Wires from each player station are directed through the ducts 410 to a common area 502, which may be occupied by a central controller or server, as well as cooling equipment. In one implementation, the electronic game table includes a central support pedestal (not shown) that contains central control/server hardware and the cooling equipment. Then, wires are routed through a central opening 502 into the pedestal, and cooling air may also be ducted through the central opening 502 (i.e., the central opening into the pedestal).

Example Method

Figure 6:
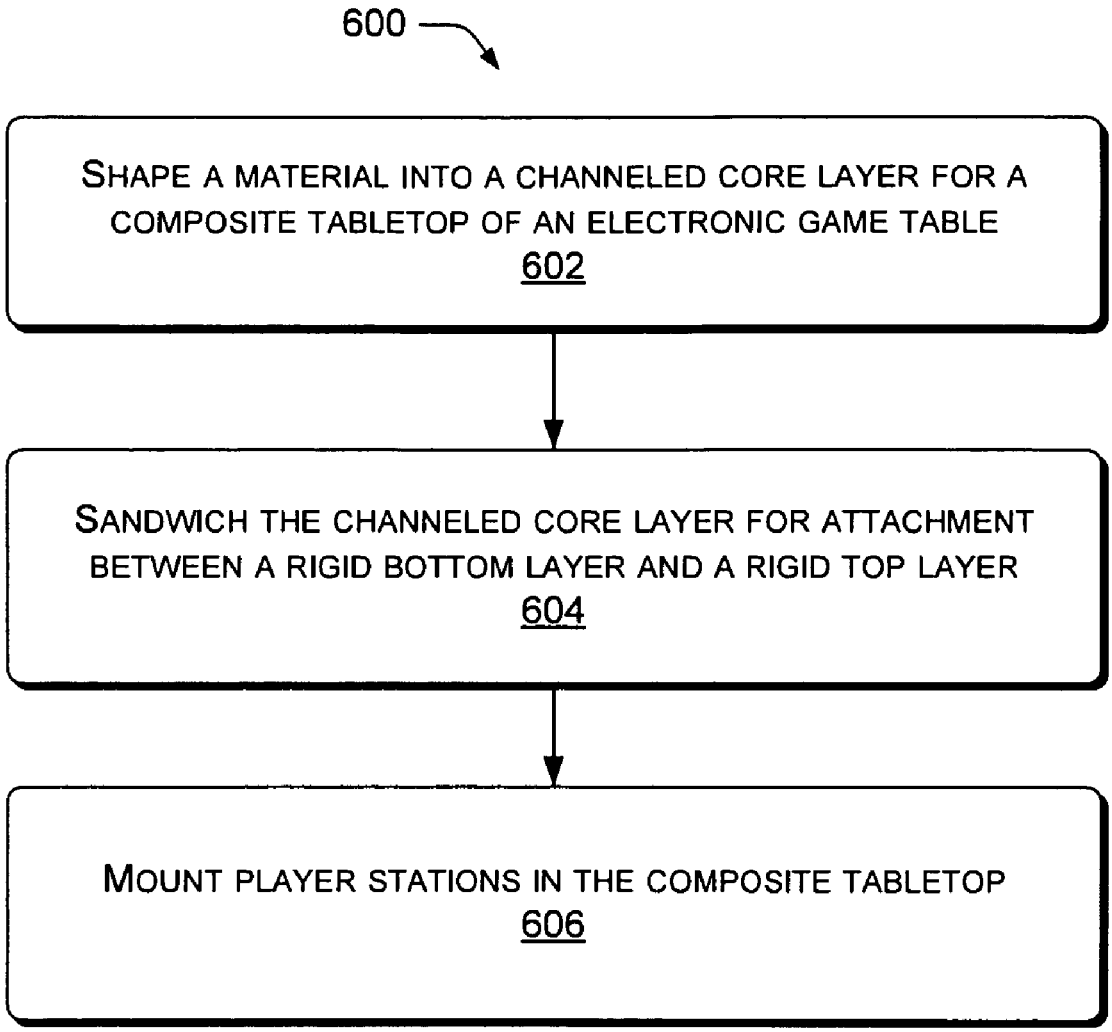
FIG. 6 is a flow diagram of an exemplary method of constructing an exemplary composite tabletop for electronic game tables.

FIG. 6 shows an exemplary method 600 of constructing a composite tabletop for an electronic game table. In the flow diagram, the operations are summarized in individual blocks.

At block 602, material, such as a rigid foam, is shaped into a channeled core layer for a composite tabletop of an electronic game table. When foam is used, such as polystyrene or polyvinylchloride foam, the foam may be molded into at least part of the channeled core layer or the foam may be cut into the channeled core layer, for example, cut by a hot wire cutting technique.

The material, such as foam, is molded, cut, or formed into the channeled core layer, which has an enclosure space for each player station in the electronic game table and wherein the foam forms duct spaces between each enclosure space and a central space in the channeled core layer. The enclosure spaces are designed to closely approximate the hardware of each display or player station to be mounted, so that when a positive or negative airflow is applied to the duct space of each enclosure, the close fit of the enclosure space ensures a sufficient airflow velocity to cool the player station hardware and electronics.

The duct spaces may also be formed as conduits or with extra channels to be used as conduits for wires (or cooling tubes) between the enclosures for the player stations and the central space. The central space typically has a central controller or computer server, i.e., a network hub, and typically has a main heat management system, such a central cooling fan, even though there may be peripheral cooling fans for each player station.

Various foam materials may be used for the channeled core layer, depending on implementation. For example, the material may be a polystyrene foam, a polymethacrylimide foam, a polyvinylchloride foam, a polyurethane foam, a polypropylene foam, a polyethylene foam, or even an expanded paper or cardboard mesh or honeycomb.

At block 604, the channeled core layer is sandwiched for attachment between a rigid bottom layer and a rigid top layer. The bottom layer supports the composite tabletop while the top layer forms a cover or cover support, and has openings for mounting player stations, displays, controls, and various user interfaces that depend upon game implementation. The channeled core layer is attached to the top layer and the bottom layer with an adhesive that is compatible with rigid foam or other material used to create the channeled core layer. The layers may also be fastened together with mechanical fasters, such as screws, nails, bolts, staples, etc.

At block 606, player stations are mounted in the composite tabletop. The player stations consist of at least a display and typically consist of a computing device or a workstation. When the hardware is mounted in the composite tabletop, the electronic game table as a whole is favorably lightweight because of the presence of the channeled core layer. The composite tabletop absorbs unwanted noise, such a humming, hard drive clicks, cooling fan white noise, etc., generated by the hardware and electronics. The channeled core layer helps absorb shocks to the mounted electronics and hardware, for example, when an impact occurs during shipping or when a player pounds a first on the table. Foam construction of the channeled core layer also greatly simplifies game table construction over conventional methods of building up the hardware mountings out of wood or metal.

CONCLUSION

Although exemplary systems have been described in language specific to structural features and/or methodological acts, it is to be understood that the subject matter defined in the appended claims is not necessarily limited to the specific features or acts described. Rather, the specific features and acts are disclosed as exemplary forms of implementing the claimed systems, methods, and structures.

The invention claimed is:

1. A composite tabletop for an electronic game table, comprising:

a bottom layer of rigid material for supporting the composite tabletop;

a top layer of rigid material with openings for enabling the top layer to support at least player stations of the electronic game table;

a channeled core layer sandwiched between the bottom layer and the top layer; and wherein the channeled core layer is constructed of foam, the foam forming an enclosure space for each player station and the foam forming a duct space between each enclosure space and a central space in the channeled core layer.

2. The composite tabletop as recited in claim 1, wherein the channeled core layer has enclosure spaces that closely approximate the dimensions of player station hardware.

3. The composite tabletop as recited in claim 1, wherein the channeled core layer has duct spaces dimensioned to cause an air movement in each associated enclosure space when an air pressure is applied to the central space.

4. The composite tabletop as recited in claim 3, wherein a negative air pressure is applied to the central space to cause a partial vacuum in each enclosure space.

5. The composite tabletop as recited in claim 1, wherein the channeled core layer is constructed of foam that forms duct spaces dimensioned to mount a cooling fan in each duct space.

6. The composite tabletop as recited in claim 1, wherein the channeled core layer is constructed of foam that forms duct spaces, each duct space having a channel to route wires between the associated enclosure space and the central space, and each duct space dimensioned to cause an air movement in each associated enclosure space when a positive or negative air pressure is applied to the central space.

7. The composite tabletop as recited in claim 1, wherein the foam further comprises a polystyrene foam, wherein the polystyrene foam has a density of approximately 28-45 kg/cubic meter.

8. The composite tabletop as recited in claim 1, wherein the foam further comprises a polyvinylchloride foam, wherein the polyvinylchloride foam has a density of approximately 30-120 kg/cubic meter.

9. The composite tabletop as recited in claim 1, wherein at least one of the top layer or the bottom layer are composed of one of wood, metal, or engineered composite.

10. An electronic game table, comprising:

multiple player stations each player station having at least a visual display for presenting images of virtual game pieces to a player;

a central processor for executing game instructions according to game rules and for generating the images of the virtual game pieces;

a composite tabletop that includes:

a bottom layer of rigid material for supporting the composite tabletop;

a top layer of rigid material with openings for supporting the multiple player stations; and a channeled core layer sandwiched between the bottom layer and the top layer, wherein the channeled core layer is constructed of foam, wherein the foam forms an enclosure space for each player station and wherein the foam forms duct spaces between each enclosure space and a central space in the channeled core layer.

11. The electronic game table as recited in claim 10, wherein the channeled core layer has enclosure spaces that closely approximate the dimensions of player station hardware; and wherein the channeled core layer has duct spaces dimensioned to cause an air movement in each associated enclosure space when a positive or negative air pressure is applied to the central space.

12. The electronic game table as recited in claim 10, wherein the channeled core layer is constructed of foam that forms duct spaces dimensioned to mount a cooling fan in each duct space.

13. The electronic game table as recited in claim 10, wherein the channeled core layer is constructed of foam that forms duct spaces, each duct space having a channel to route wires between the associated enclosure space and the central space, and each duct space dimensioned to cause an air movement in each associated enclosure space when a positive or negative air pressure is applied to the central space.

14. The electronic game table as recited in claim 10, wherein the foam comprises one of a polystyrene foam, a polymethacrylimide foam, a polyvinylchloride foam, a polyurethane foam, a polypropylene foam, or a polyethylene foam.

15. The electronic game table as recited in claim 10, wherein in foam comprises an expanded paper honeycomb.

16. The electronic game table as recited in claim 10, wherein at least one of the top layer or the bottom layer are composed of one of wood, metal, or engineered composite.

17. A method, comprising:

shaping a material into a channeled core layer for a composite tabletop of an electronic game table;

sandwiching the channeled core layer for attachment between a rigid bottom layer and a rigid to layer;

mounting player stations in the composite tablet;

wherein shaping the material into a channeled core layer further comprises shaping foam, wherein the foam forms an enclosure space for each player station and wherein the foam forms duct spaces between each enclosure space and a central space in the channeled core layer.

18. The method as recited in claim 17, wherein shaping the material includes molding a foam or cutting a foam into at least part of the channeled core layer, wherein the foam comprises one of a polystyrene foam, a polymethacrylimide foam, a polyvinylchloride foam, a polyurethane foam, a polypropylene foam, or a polyethylene foam.

19. The method as recited in claim 17, further comprising routing wires from each player station through an associated duct space to the central space and directing an airflow through each duct space.

* * * * *